US008393593B2

(12) United States Patent
Hoff

(10) Patent No.: US 8,393,593 B2
(45) Date of Patent: Mar. 12, 2013

(54) PORTABLE MOLDING APPARATUS FOR CONSTRUCTING PRE-CAST STRUCTURES

(76) Inventor: William Randall Hoff, Las Vegas, NV (US)

( * ) Notice: Subject to any disclaimer, the term of this patent is extended or adjusted under 35 U.S.C. 154(b) by 22 days.

(21) Appl. No.: 13/414,386

(22) Filed: Mar. 7, 2012

(65) Prior Publication Data

US 2012/0168603 A1 Jul. 5, 2012

Related U.S. Application Data

(62) Division of application No. 12/207,608, filed on Sep. 10, 2008, now abandoned.

(60) Provisional application No. 60/971,468, filed on Sep. 11, 2007.

(51) Int. Cl.
*B41B 11/68* (2006.01)

(52) U.S. Cl. ..... 249/120; 425/182; 264/253; 249/155

(58) Field of Classification Search ..... 264/253; 249/33, 36, 120, 129, 155, 158; 425/182
See application file for complete search history.

(56) References Cited

U.S. PATENT DOCUMENTS

| | | | | |
|---|---|---|---|---|
| 4,761,126 | A * | 8/1988 | del Valle | 425/62 |
| 5,520,531 | A * | 5/1996 | Del Monte | 425/432 |
| 7,073,767 | B1 * | 7/2006 | Bennett | 249/120 |
| 2009/0173871 | A1 * | 7/2009 | Stott et al. | 249/33 |

* cited by examiner

*Primary Examiner* — Galen Hauth
(74) *Attorney, Agent, or Firm* — Aidenbaum Schloff and Bloom PLLC; Jay Schloff

(57) ABSTRACT

Disclosed is a portable molding apparatus for constructing pre-cast structure. The portable molding apparatus comprises a container, a plurality of partition members, at least one retainer, and a plurality of spacing members. The container comprises a floor, and a pair of longitudinal walls vertically extending from the floor for configuring an interior space therebetween. The plurality of partition members is supported on the floor in a spaced apart manner. The at least one retainer is positioned between at least one pair of partition members of the plurality of partition members for configuring at least two sets of partition members. The plurality of spacing members is positioned between partition members of each of the at least two sets of partition members for configuring a plurality of mold cavities therebetween. The plurality of mold cavities is adapted to receive a building material for constructing the pre-cast structures.

7 Claims, 6 Drawing Sheets

PORTABLE MOLDING APPARATUS FOR CONSTRUCTING PRE-CAST STRUCTURES

CROSS REFERENCE TO RELATED APPLICATIONS

The present disclosure is a divisional application of U.S. patent application Ser. No. 12/207,608, filed on Sep. 10, 2008 and claims priority under 35 United States Code, Section 119 on the U.S. Provisional Patent Application No. 60/971,468 filed on Sep. 11, 2007, the disclosures of which are incorporated by reference.

FIELD OF THE INVENTION

The present invention generally relates to a construction industry, and, more particularly, to a portable molding apparatus for constructing pre-cast structure, such as roof panels, wall panels, and bridge sections, in the vicinity of a construction site of an architectural structure, such as a residential building, a commercial building, and a bridge.

BACKGROUND OF THE INVENTION

With growing population throughout the world, there has been a corresponding steady increase in the number of architectural structures, such as residential buildings, commercial buildings, and bridges. Building of such architectural structures generally involves utilization of pre-cast structures, such as roof panels, wall panels, bridge sections, box culverts, underground supports, stair systems, concrete retainer walls, fencing, beams, and columns Typically, such pre-cast structures are manufactured in industries using conventional concrete molding apparatuses.

More often, it has been observed that such industries are located at a remote place, far from a construction site of the architectural structures. Accordingly, the pre-cast structures, produced in the remote industries, need to be transported to the construction site. The pre-cast structures may be transported to the construction site by using various transportation means, such as road, rail and water transportation. The transportation of the pre-cast structures to the construction site may increase the overall cost involved in the building of the architectural structure. Further, the transported pre-cast structures need to be stored in a proper manner for the further use thereof. More specifically, extra storage space and extra labor for handling the transported pre-cast structures may be required, which may further increase the overall cost involved in the building of the architectural structures.

Moreover, the conventional concrete molding apparatuses used in the industry, does not include a standard size that may enable in easy transportation thereof. Specifically, the conventional concrete molding apparatuses are configured to assume bulky configurations. Therefore, transportation of such conventional concrete molding apparatuses to the construction site may be a difficult task.

Accordingly, there exists a need for a portable molding apparatus for constructing pre-cast structures in the vicinity of a construction site of an architectural structure.

SUMMARY OF THE INVENTION

In view of the forgoing disadvantages inherent in the prior art, the general purpose of the present invention is to provide a portable molding apparatus for constructing pre-cast structures that is configured to include all advantages of the prior art, and to overcome the drawbacks inherent in the prior art.

Accordingly, an object of the present invention is to provide a portable molding apparatus for constructing pre-cast structures, such as roof panels, wall panels, bridge sections, box culverts, underground supports, stair systems, concrete retainer walls, fencing, beams, and columns, in vicinity of a construction site of an architectural structure.

Another object of the present invention is to provide a portable molding apparatus which may be easily transported to a construction site.

Yet another object of the present invention is to provide a portable molding apparatus which enables in lowering an overall cost associated with the building of an architectural structure.

In light of the above objects, in one aspect of the present invention, a portable molding apparatus for constructing pre-cast structure is disclosed. The portable molding apparatus comprises a container, a plurality of partition members, at least one retainer, and a plurality of spacing members. The container comprises a floor, and a pair of longitudinal walls vertically extending from the floor of the container. The pair of longitudinal walls and the floor configures an interior space therebetween. The plurality of partition members is adapted to be received in the interior space of the container in a spaced apart manner such that the plurality of partition members is supported on the floor of the container. The at least one retainer is adapted to be positioned between at least one pair of partition members of the plurality of partition members for configuring at least two sets of partition members. The plurality of spacing members is adapted to be positioned between partition members of each of the at least two sets of partition members. The plurality of spacing members, the floor of the container, and the partition members configure a plurality of mold cavities therebetween. The at least one retainer enables in maintaining configuration of the plurality of mold cavities. The plurality of mold cavities is adapted to receive a building material for constructing the pre-cast structures.

In another aspect of the present invention, the container of the portable molding apparatus is a shipping-container such that container is configured to have an international container specifications which enables in easy transportation thereof.

These together with the other aspects of the present invention, along with the various features of novelty that characterize the present invention, are pointed out with particularity in the claims annexed hereto and form a part of the present invention. For a better understanding of the present invention, its operating advantages, and the specified object attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

The exemplary embodiments described herein detail for illustrative purposes are subject to many variations in implementation thereof. It should be emphasized, however, that the present invention is not limited to portable molding apparatus for constructing pre-cast structures, as shown and described. It is understood that various omissions and substitutions of equivalents are contemplated as circumstances may suggest or render expedient, but these are intended to cover the application or implementation without departing from the spirit or scope of the claims of the present invention.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present invention provides a portable molding apparatus for constructing pre-cast structures, such as roof panels, wall panels, bridge sections, box culverts, underground supports, stair systems, concrete retainer walls, fencing, beams, and columns. Such pre-cast structures may be utilized in building an architectural structure, such as a residential building, a commercial building, and a bridge. The portable molding apparatus of the present invention enables in constructing pre-cast structures in the vicinity of a construction site of the architectural structures.

Figure 1:
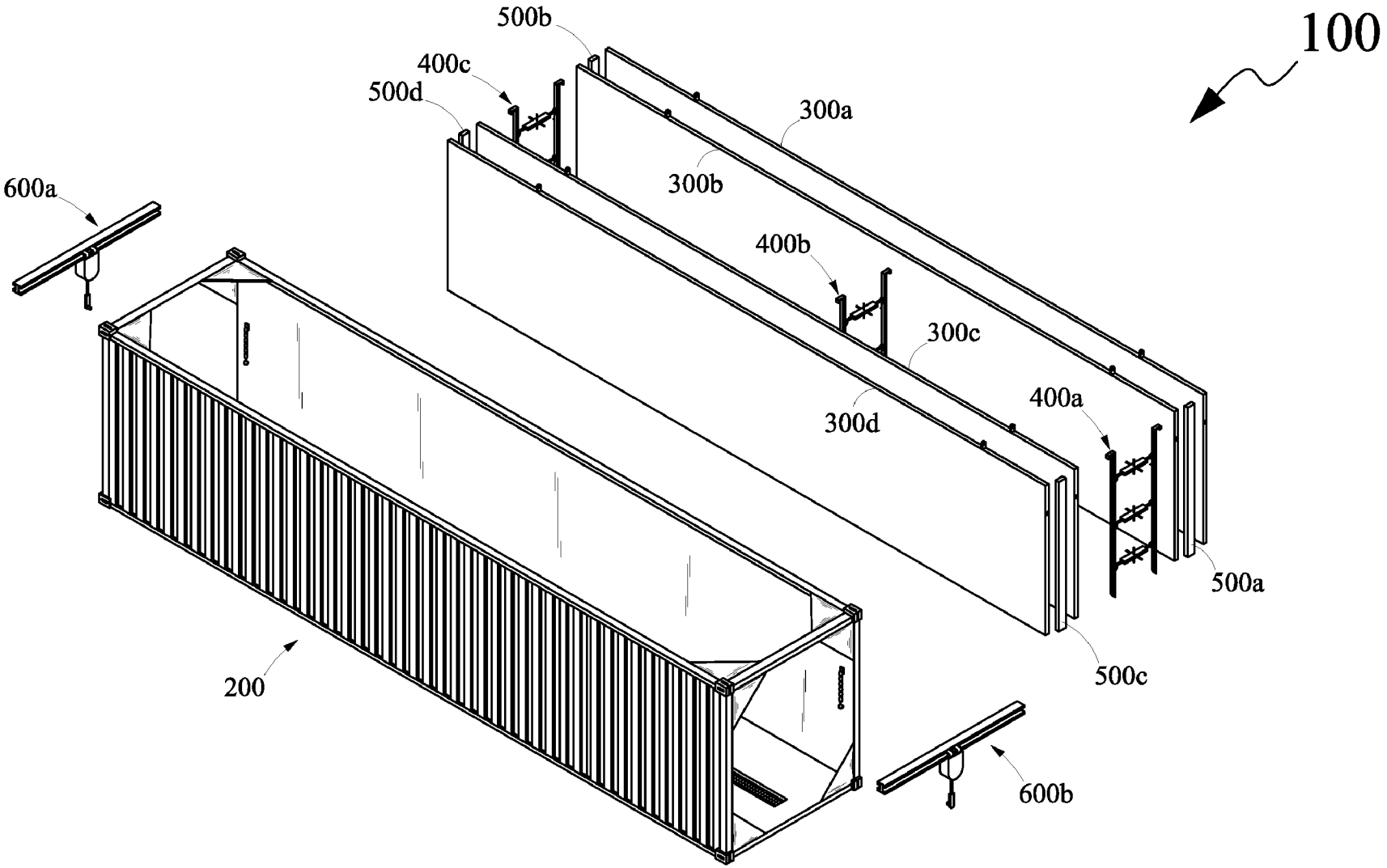
FIG. 1 illustrates an exploded perspective view of a portable molding apparatus for constructing pre-cast structures, in accordance with an exemplary embodiment of the present invention.

Referring now to FIG. 1, a portable molding apparatus 100 for constructing pre-cast structures is illustrated, in accordance with an exemplary embodiment of the present invention. The portable molding apparatus 100 (hereinafter referred to as apparatus 100) includes a container 200, a plurality of partition members, such as partition members 300*a*, 300*b*, 300*c* and 300*d* (hereinafter collectively referred as a plurality of partition members 300), at least one retainer, such as retainers 400*a*, 400*b*, and 400*c* (hereinafter collectively referred as retainers 400), and a plurality of spacing members, such as spacing members 500*a*, 500*b*, 500*c*, and 500*d* (hereinafter collectively referred as to a plurality spacing members 500).

The plurality of partition members 300 is adapted to be received in the container 200. The retainers 400 are adapted to the positioned between at least one pair of partition members of the plurality of partition members 300, received in the container 200, for configuring at least two sets of partition members. The plurality of spacing members 500 is adapted to be positioned between partition members of the at least two sets of partition members of the plurality of partition members 300 for configuring a plurality of mold cavities (not shown). The plurality of mold cavities may be utilized for constructing pre-cast structures. The positioning of the plurality of partition members 300, retainers 400, and the plurality of spacing members 500 in container 200 for configuring the plurality of mold cavities is further explained in detail in conjunction with FIG. 6. The apparatus 100 further includes a pair of maneuvering mechanisms, such as maneuvering mechanisms 600*a* and 600*b* (hereinafter collectively referred as maneuvering mechanisms 600) which enables in maneuvering the plurality of partition members 300 within the container 200. The maneuvering mechanisms 600 are further explained in detail in conjunction with FIG. 5.

Figure 2:
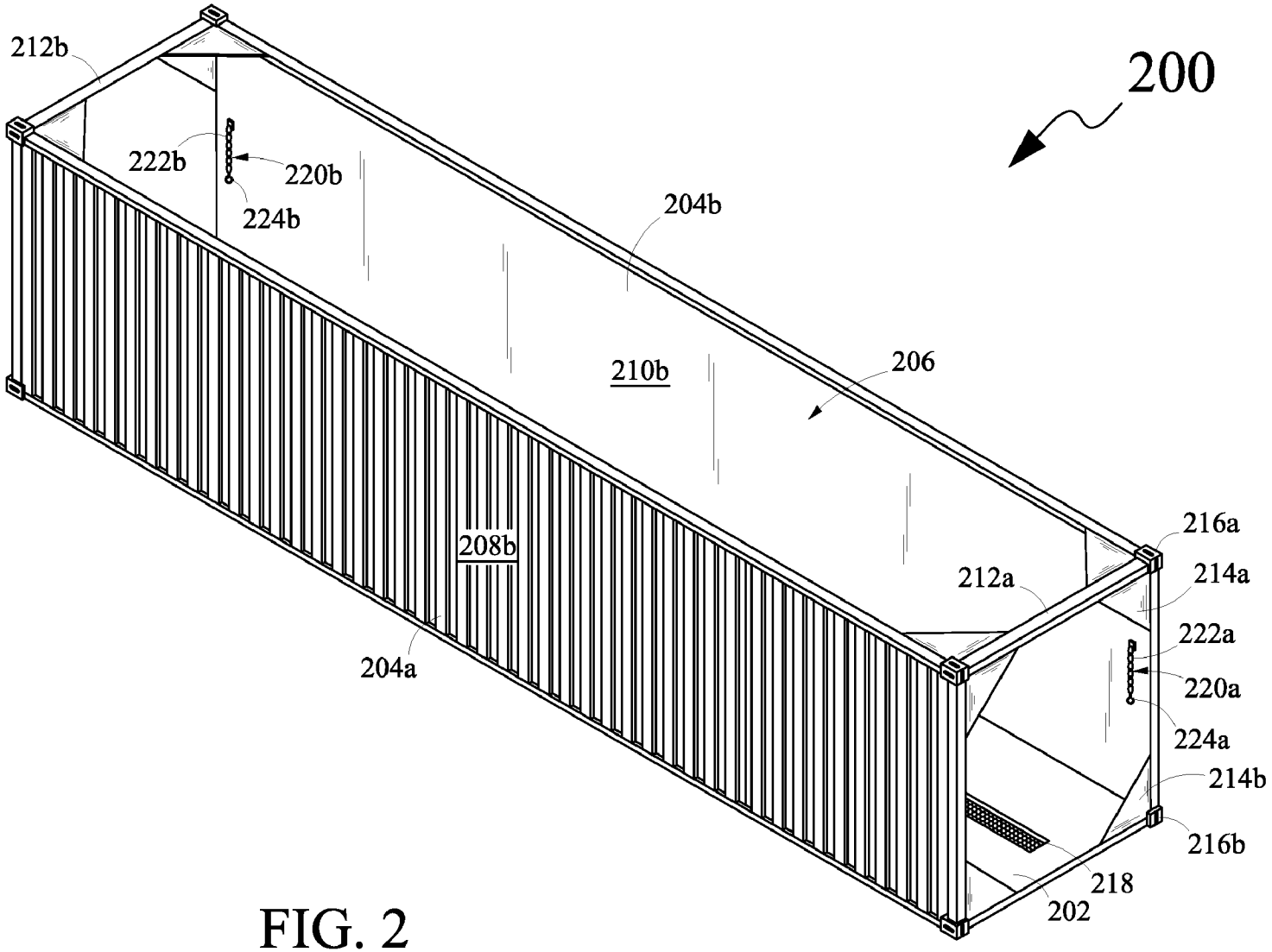
FIG. 2 illustrates a perspective view of a container of the portable molding apparatus, in accordance with an exemplary embodiment of the present invention.

Referring now to FIG. 2, a perspective view of the container 200 of the apparatus 100 is illustrated, in accordance with an exemplary embodiment of the present invention. The container 200 includes a floor 202, and a pair of longitudinal walls, such as longitudinal walls 204*a* and 204*b*, vertically extending from the floor 202. Specifically, the longitudinal walls 204*a* and 204*b* extend vertically upward from longitudinal edges (not shown) of the floor 202. The longitudinal walls 204*a* and 204*b*, and the floor 202 configure an interior space 206 therebetween. The interior space 206 of the container 200 is adapted to receive the plurality of partition members 300 therein. As shown in FIG. 1, the container 200 of the present invention is configured to assume an open top hollow cuboidal structure.

In one embodiment of present invention, the container 200 is a conventional shipping container (38' long by 8½" high) having international container specifications. In such an embodiment, up to ten four-inch panels may be cast at a time. More specifically, the conventional shipping container includes longitudinal walls, such as longitudinal walls 204*a* and 204*b*, side doors (not shown), a floor, such as the floor 202 and a roof (not shown). Accordingly, in such an instance, the container 200 of the present invention may be configured from the conventional shipping container by removing side doors and the roof of the conventional shipping container. However, it will be evident to a person skilled in the art that the container 200 of the present invention may be configured by arranging any longitudinal walls, such as longitudinal walls 204*a* and 204*b*, and any floor, such the floor 202, which may not be, essentially, a part of the conventional shipping container.

As explained herein, the container 200 may be the conventional shipping container. Accordingly, the floor 202 and the longitudinal walls 204*a* and 204*b* are configured to assume a rectangular structure. Further, the longitudinal walls 204*a* and 204*b* may be configured to have corrugated surfaces, having alternate grooves and ridges configured thereon. More specifically, outer surfaces of the longitudinal walls 204*a* and 204*b* may be configured to have a corrugated shape. For example, an outer surface, such as an outer surface 208*a* of the longitudinal wall 204*a* may be configured to have the corrugated shape, as shown in FIG. 1. The corrugated outer surfaces of the longitudinal walls 204*a* and 204*b* enables in increasing a bending strength of the longitudinal walls 204*a* and 204*b*. However, inner surfaces of the longitudinal walls 204*a* and 204*b* may be configured to have flat surfaces. For example, an inner surface, such as an inner surface 210*b* of the longitudinal walls 204*b* may be configured to have the flat surface, as shown in FIG. 1.

In one embodiment of the present invention, the container 200 may include a pair of support frames, such as support frames 212*a* and 212*b*, and a plurality of gusset, such as gussets 214*a* and 214*b*. The support frames 212*a* and 212*b* extends between opposite top end corners of the longitudinal walls 204*a* and 204*b*. The plurality of gussets extends between the support frame 212*a* and 212*b*, and the longitudinal walls 204*a* and 204*b*. Further, the plurality of gusset also extends between the floor 202 and the longitudinal walls 204*a* and 204*b*. For example, the gusset 214*a* extends between the support frame 212*a* and the longitudinal wall 204*a*, whereas the gusset 214*b* extends between the longitudinal wall 204*b* and the floor 202. The support frames 212*a* and 212*b*, and the plurality of gussets, such as gussets 214*a* and 214*b*, enables in strengthening a configuration of the container 200. The container 200 may further include a plurality of corner couplings, such as coupling 216*a*, and 216*b*. The plurality of coupling enable in attaching the support frames 212*a* and 212*b* with the longitudinal walls 204*a* and 204*b*, and attaching the floor 202 with longitudinal walls 204*a* and 204*b*. For example, the coupling 216*a* enables in attaching the support frame 212*a* with the longitudinal walls 204*b*, whereas the coupling 216*b* enables in attaching the floor 202 with the longitudinal walls 204*b*.

In one embodiment of the present invention, the floor 202 of the container 200 includes a drainage portion 218 configured at a portion of the floor 202. More specifically, the drainage portion 218 is configured centrally along a length of the floor 202. In the present embodiment, the drainage portion 218 is configured on the floor 202 by installing a grating member at the portion of the floor 202. The drainage portion 218 facilitates in cleaning the container 200. In one embodiment of the present invention, the drainage portion 218 may have a width of about 1 foot. Additionally, the floor 202 and the pair of longitudinal walls 204*a* and 204*b* may be made of material, such as steel, aluminum, and wood plastic.

The container 200 of the present invention further includes a plurality of supporting arrangements, such as supporting arrangements 220*a* and 220*b*, configured on the longitudinal wall 204*b*. The longitudinal wall 204*a* also includes supporting arrangements (not shown), such as supporting arrangements 220*a* and 220*b*. More specifically, the supporting arrangements, such as the supporting arrangements 220*a* and 220*b*, are configured at lateral edges of the longitudinal wall 204*a* and 204*b*. The supporting arrangements 220*a* and 220*b* includes a support chain and a support hook. For example, the supporting arrangement 220*a* includes a support chain 222*a* and a support hook 224*a*. The support chain 222*a* is coupled to a lateral edge of the longitudinal wall 204*b* at a first end of the support chain 222*a*. The support hook 224*a* is coupled to the support chain 222*a* at second end of the support chain 222*a*. Similarly, the supporting arrangement 220*b* includes a support chain 222*b* and a support hook 224*b* and configured on the longitudinal wall 204*b*. The supporting arrangements 220*a* and 220*b* (hereinafter collectively referred as supporting arrangements 220) enables in supporting the plurality of partition members 300 on the floor 202 of the container 200, which is further explained in conjunction with FIG. 6.

Figure 3:
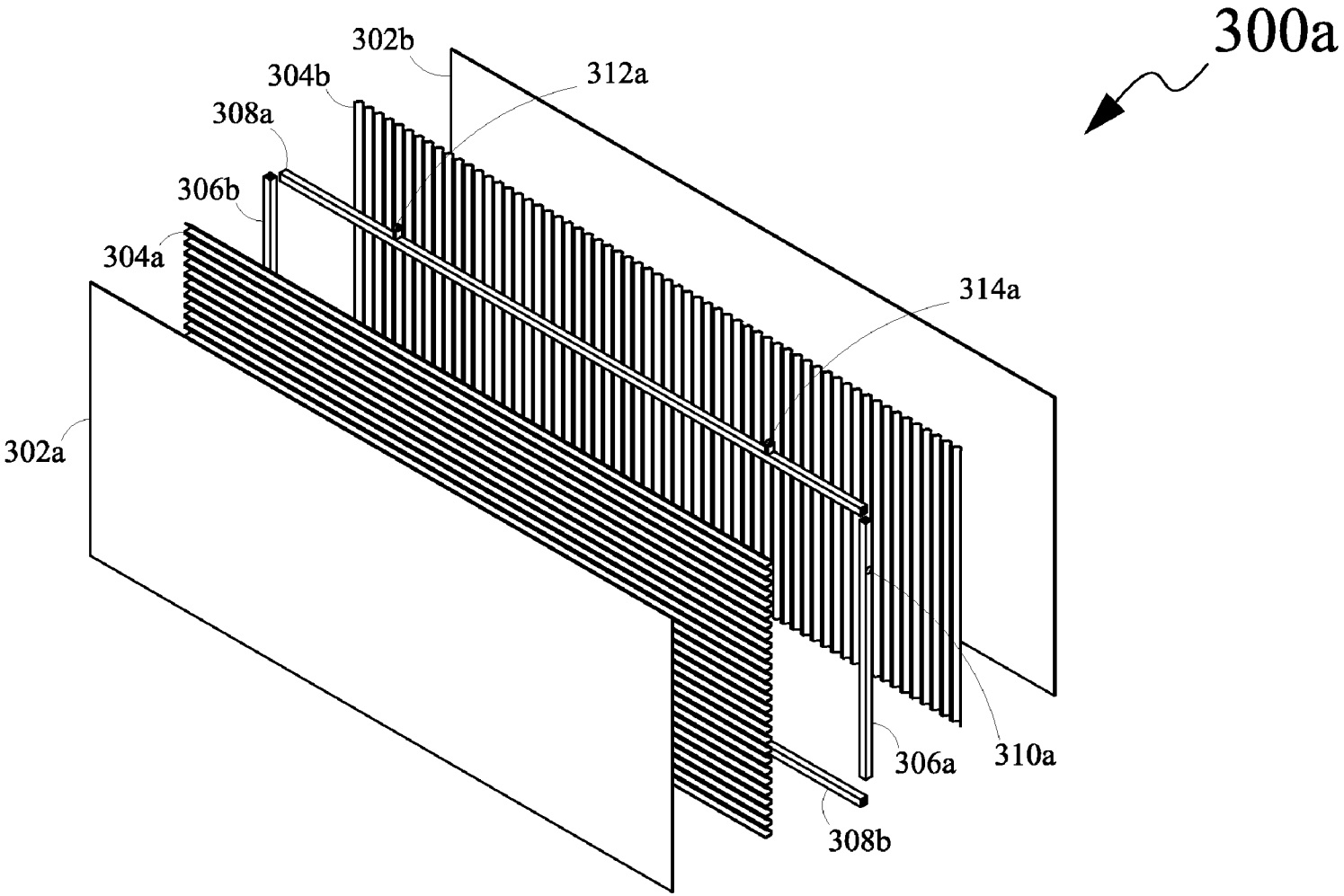
FIG. 3 illustrates an exploded perspective view of a partition member of the portable molding apparatus, in accordance with an exemplary embodiment of the present invention.

Referring now to FIG. 3, an exploded perspective view of the partition member 300*a* of the apparatus 100 is illustrated, in accordance with an exemplary embodiment of the present invention. The partition member 300*a* includes a pair of first sheets, such as first sheets 302*a* and 302*b*, a pair of second sheets, such as second sheets 304*a* and 304*b*, a pair of lateral frame members, such as lateral frame members 306*a* and 306*b*, and a pair of longitudinal frame members, such as longitudinal frame members 308*a* and 308*b*.

As shown in FIG. 3, the pair of first sheets 302*a* and 302*b* is configured to assume a flat structure, having a plane surface. In one embodiment of the present invention the pair of first sheets 302*a* and 302*b* is a galvanized metal sheet having a plane surface. (It will be apparent that the sheets 302*a*, 302*b*, 304*a* and 304*b* may be formed from plastic or wood or other suitable materials.) Further, the pair of second sheets 304*a* and 304*b* is configured to assume a corrugated structure, having alternate grooves and ridges configured thereon. In one embodiment of the present invention, the pair of second sheets 304*a* and 304*b* is a steel sheet having the corrugated structure. However, the second sheet 304*a* is configured to have a horizontal corrugated structure, whereas the second sheet 304*b* is configured to have a vertical corrugated structure. The horizontal corrugated structure and vertical corrugated structure of the second sheet 304*a* and the second sheet 304*b*, respectively, enables in increasing a bending strength of the partition member 300*a*. More specifically, horizontal and vertical ridges of the second sheets 304*a* and 304*b*, respectively, configure a crisscross pattern, which strengthens the partition members 300*a*, laterally and longitudinally, after configuration thereof.

For configuring the partition members 300*a*, the pair of second sheets 304*a* and 304*b* is adapted to be disposed between the pair of first sheets 302*a* and 302*b*. Thereafter, the pair of lateral frame members 306*a* and 306*b* is adapted to be coupled to lateral peripheral edges of the pair of first sheets 302*a* and 302*b*. Moreover, the pair of longitudinal frame members 308*a* and 308*b* is adapted to be coupled to longitudinal peripheral edges of the pair of first sheets 302*a* and 302*b*. The coupling of the pair of lateral frame members 306*a* and 306*b*, and the pair of longitudinal frame members 308*a* and 308*b*, about the lateral peripheral edges and the longitudinal peripheral edges, respectively, of the pair of first sheets 302*a* and 302*b* enables in configuring the partition member 300*a*. In one embodiment of the present invention, the lateral frame members 306*a* and 306*b*, and the longitudinal frame members 308*a* and 308*b* are coupled to respective peripheries of the pair of first sheets 302*a* and 302*b* by a process of welding.

Further, each lateral frame member of the pair of lateral frame members 306*a* and 306*b* includes a locking cavity configured thereon. For example, the lateral frame member 306*a* is configured with a locking cavity 310*a*. Similarly, the lateral frame members 306*b* is also configured with a locking cavity (not shown), such as the locking cavity 310*a*. The locking cavity, such as the locking cavity 310*a*, of the lateral frame members 306*a* and 306*b* enables in maneuvering the partition member 300*a* within the interior space 206 of the container 200 with the help of maneuvering mechanisms 600, which is further explained in detail in conjunction with FIGS. 5 and 6.

In one embodiment of the present invention, the longitudinal frame member 308*a* includes at least one lifting lug, such as lifting lugs 312*a* and 314*a*, configured thereon. The lifting lugs 312*a* and 314*a*, enables in lifting the partition member 300*a* out of the interior space 206 of the container 200, which is further explained in detail in conjunction with FIG. 6. In the present embodiment, the lateral frame members 306*a* and 306*b*, and the longitudinal frame members 308*a* and 308*b* are configured to assume a shape of steel tubing, having hollow square cross section. Such configuration of the plurality of partition members 300 enables in reducing a weight the plurality of partition members 300. Further, it should be understood that the structural configuration and functionality of the partition members 300*b*, 300*c* and 300*d* are similar to the partition member 300*a*, as described herein. Accordingly, a detailed explanation thereof has been avoided for sake of brevity.

Figure 4:
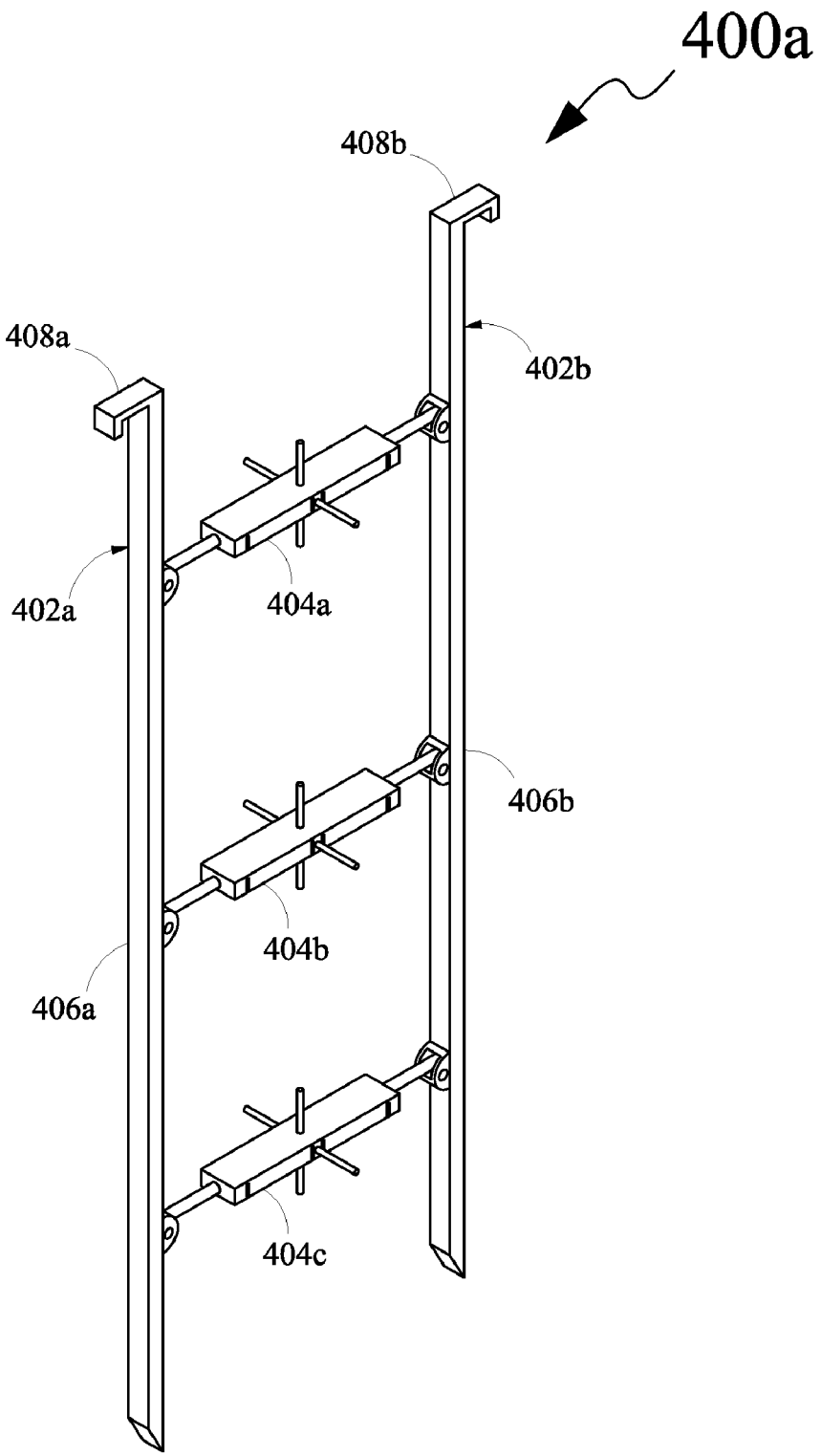
FIG. 4 illustrates a perspective view of a retainer of the portable molding apparatus, in accordance with an exemplary embodiment of the present invention.

As explained herein, the retainers 400 are adapted to be positioned between the at least one pair of partition members of the plurality of partition members 300 for configuring at least two sets of partition members. Further, the retainers 400 enable supporting the plurality of partition members 300 on the floor 202 of the container 200. Referring now to FIG. 4, a perspective view of the retainer 400*a* of the apparatus 100 is illustrated, in accordance with an exemplary embodiment of the present invention. The retainer 400*a* includes a pair of mounting brackets, such as mounting brackets 402*a* and 402*b*, and at least one tensioning member, such as tensioning members 404*a*, 404*b* and 404*c*. The tensioning member 404*a*, 404*b* and 404*c* are configured between the pair of mounting brackets 402*a* and 402*b* for adjusting a distance between the pair of mounting brackets 402*a* and 402*b*.

In one embodiment of the present invention, each of the pair of the mounting brackets 402*a* and 402*b* includes an elongated portion and a curved portion configured at an end of the elongated portion. More specifically, the mounting bracket 402*a* includes an elongated portion 406*a* and a curved portion 408*a* configured at an end of the elongated portion 406*a*. Similarly, the mounting bracket 404*b* includes an elongated portion 406*b* and a curved portion 408*b* configured at an end of the elongated portion 406*b*.

The tensioning members 404*a*, 404*b* and 404*c* are coupled to the elongated portions 406*a*, and 406*b* of the pair of mounting brackets 402*a* and 402*b*. The tensioning members 404*a*, 404*b* and 404*c* are capable of spacing apart the pair of mounting brackets 402*a* and 402*b* in opposite directions. Further, the tensioning members 404*a*, 404*b* and 404*c* are capable of bringing the pair of mounting brackets 402*a* and 402*b* close to each other. In the present embodiment, the tensioning members 404*a*, 404*b* and 404*c* are turnbuckles, capable of moving the pair of mounting brackets 402*a* and 402*b*, as described herein. It should be understood that the structural configuration and functionality of the retainers 400*b*, and 400*c* are similar to the retainer 400*a*, as described herein. Accordingly, a detailed explanation thereof has been avoided for sake of brevity.

Figure 5:
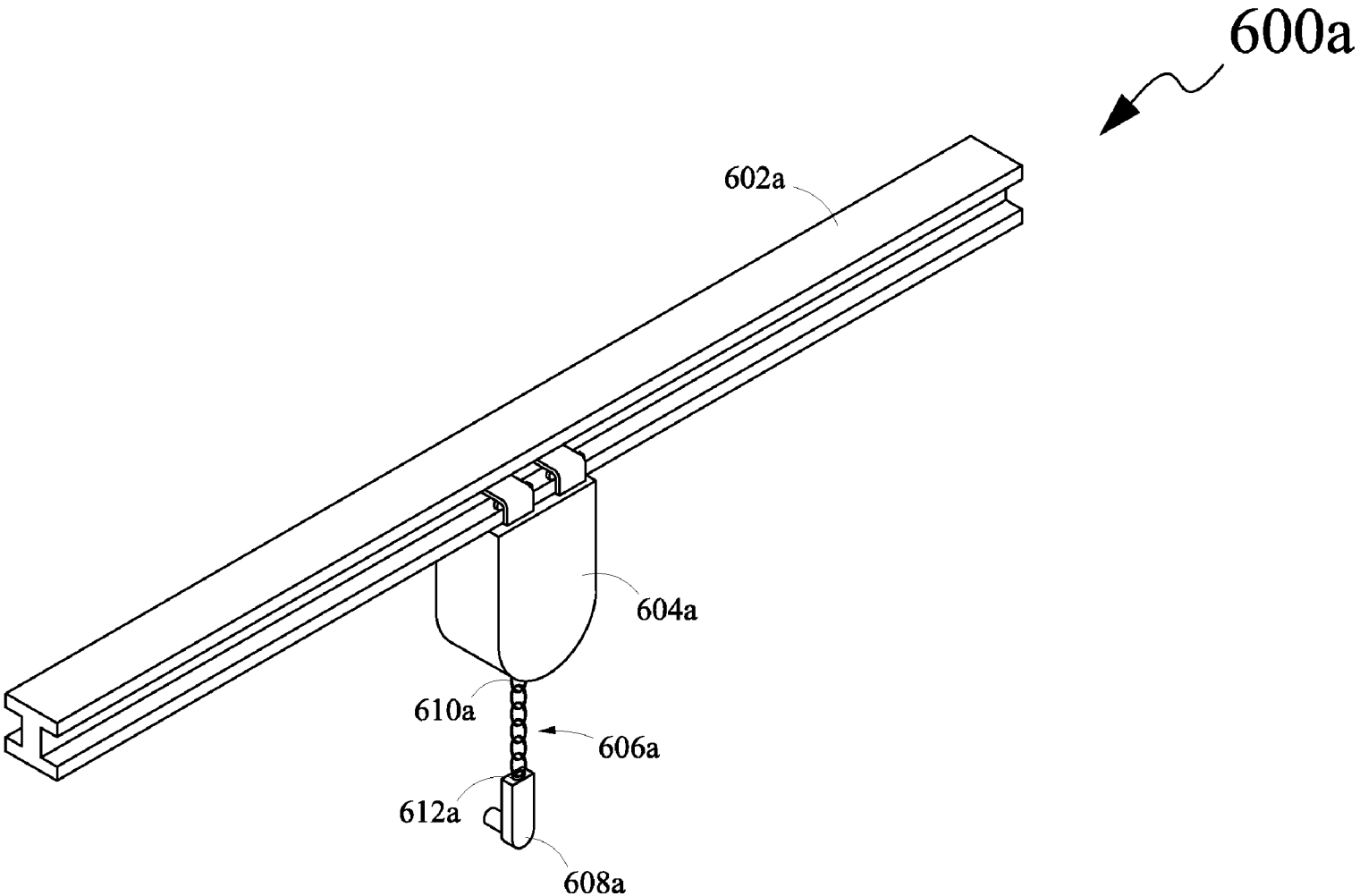
FIG. 5 illustrates a perspective view of a maneuvering mechanism of the portable molding apparatus, in accordance with an exemplary embodiment of the present invention.
Figure 6:
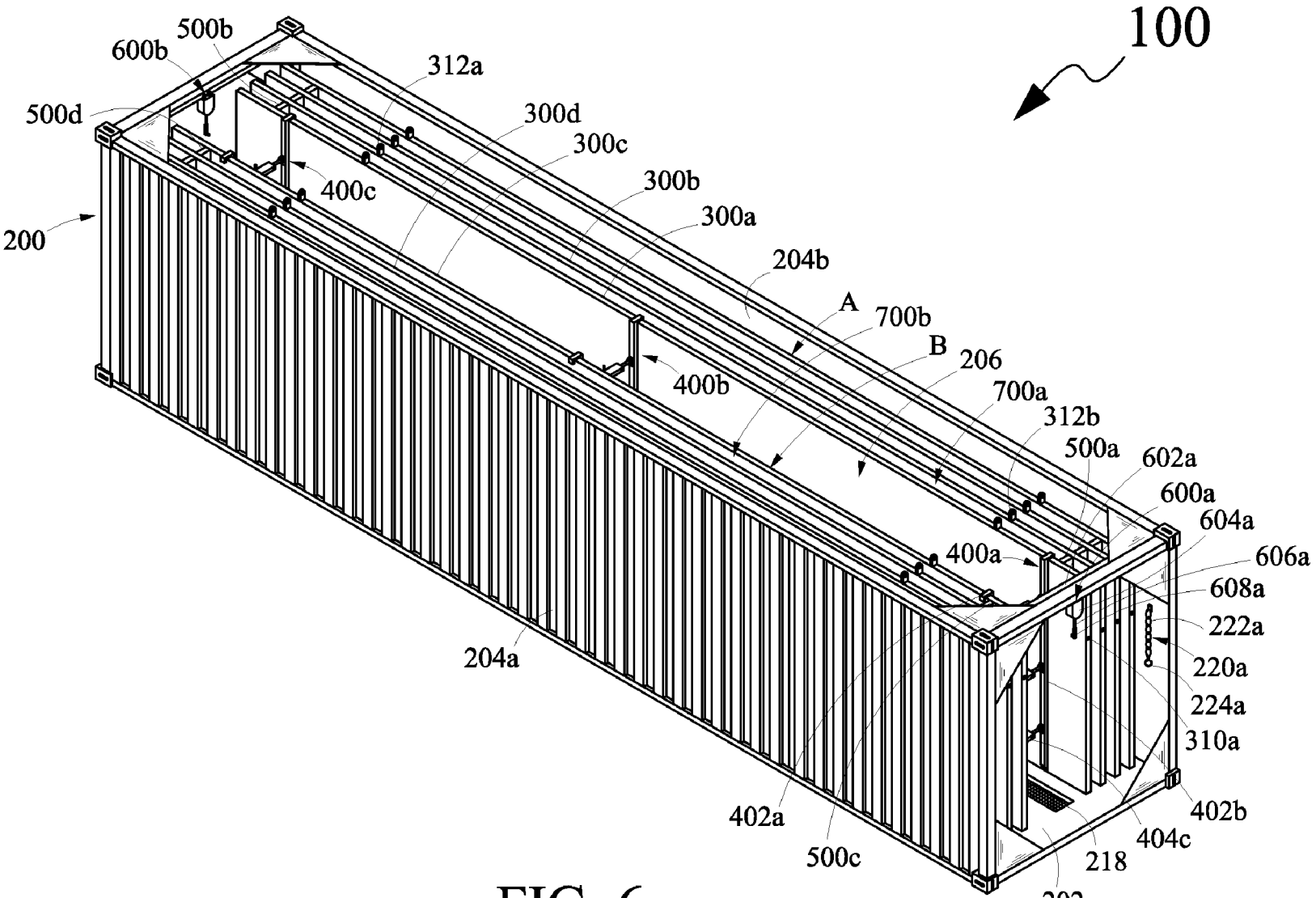
FIG. 6 illustrates an assembled perspective view of the portable molding apparatus of FIG. 1, in accordance with an exemplary embodiment of the present invention.

As explained herein conjunction with FIG. 1, the maneuvering mechanisms 600 enables in maneuvering the plurality of partition members 300 in the interior space 206 of the container 200. The maneuvering mechanisms 600 are configured between the longitudinal walls 204*a* and 204*b* of the container 200. Referring now to FIG. 5, a perspective view of the maneuvering mechanism 600*a* of the apparatus 100 is illustrated, in accordance with an exemplary embodiment of the present invention. The maneuvering mechanism 600*a* includes a support member 602*a*, a movable member 604*a*, a maneuvering chain 606*a*, and a maneuvering hook 608*a*. The support member 602*a* is adapted to extend between opposite top end corners of the pair of longitudinal walls 204*a* and 204*b*. More specifically, support member 602*a* is coupled to the opposite top end corners of the pair of longitudinal walls 204*a* and 204*b* and adjacent to the support frame 212*a*, as shown in FIG. 6. The support members 602*a* may be coupled to the longitudinal walls 204*a* and 204*b* by a process of welding. Further, the coupling of the support member 602*a* to the longitudinal walls 204*a* and 204*b* enables in further strengthening the configuration of the container 200. In one embodiment of the present invention, the support member 602*a* is configured to assume a shape of an I-beam, as shown in FIG. 5. Further, the I-beams may be made of a steel material.

The movable member 604*a* is adapted to be slidably coupled to the support member 602*a*. Specifically, the movable member 604*a* is capable of slidably moving along a length of the support members 602*a* between the opposite top end corners of the longitudinal walls 204*a* and 204*b*. In one embodiment of the present invention, the movable member 604*a* is an I-beam trolley. The I-beam trolley may include a motor and a gear arrangement which enables in slidably moving the movable member 604*a* along the length of the support members 602*a*.

Further, the maneuvering chain 606*a* is adapted to be attached to the movable member 604*a* at a first end 610*a* of the maneuvering chain 606*a*. The maneuvering chain 606*a* is capable of being operated by the movable member 604*a*. More specifically, a length of the maneuvering chain 606*a* may be adjusted by the movable member 604*a*. For example, the maneuvering chain 606*a* may be rolled and unrolled within the movable member 604*a* for adjusting the length of the maneuvering chain 606*a*. In one embodiment of the present invention, the movable member 604*a* may include a pulley arrangement, operating in conjunction with a motor, for rolling and unrolling the maneuvering chain 606*a*.

The maneuvering hook 608*a* is adapted to be attached to the maneuvering chain 606*a* at a second end 612*a* of the maneuvering chain 606*a*. The maneuvering hook 608*a* is adapted to be revived in the locking cavity 310*a* (see FIG. 3) of the lateral frame member 306*a* for enabling in maneuvering the partition members 300*a*, which is further explained in detail in conjunction with FIG. 6

Referring now to FIG. 6, an assembled perspective view of the portable molding apparatus 100 of FIG. 1 is illustrated, in accordance with an exemplary embodiment of the present invention. The plurality of partition members 300 is received in the interior space 206 of the container 200. More specifically, the plurality of partition members 300 is received in the interior space 206 of the container 200 in a spaced apart manner to be supported on the floor 202 of the container 200. The retainers 400 are positioned between the at least one pair of partition members of the plurality of partition members 300 for configuring at least two sets of partition members, such as a first set of partition members A and a second set of partition members B. More specifically, retainers 400 are positioned between the partition members 300*a* and 300*c* for configuring the first set of partition members A and the second set of partition members B. Further, in one embodiment of the present invention the apparatus 100 include three retainers, such as 400*a*, 400*b* and 400*c*. However, it will be evident to person skilled in the art that the retainers 400 may include any suitable number of retainers based on a length of the plurality of partition members 300 to be supported therewith.

Further, as shown in FIG. 6, the first set of partition members A includes the partition members 300*a* and 300*b*, and the second set of partition members B includes the partition members 300*c* and 300*d*. However, it will be evident to a person skilled in the art that the first set of partition members A and the second set of partition members B may include a multitude of partition members, such as partition members 300*a*, 300*b*, 300*c* and 300*d*, based on a size of container 200 and a number of per-cast structures needs to be constructed.

The plurality of spacing members 500 is positioned between partition members of each of the first set of partition members A and the second set of partition members B for configuring a plurality of mold cavities. More specifically, the plurality of spacing members 500, the floor 202 of the container 200, and partition members of the first set of partition members A and the second set of partition members B configure the plurality of mold cavities therebetween. For example, the spacing member 500*a* and 500*b* is positioned between the partition members 300*a* and 300*b* of the first set of partition members A for configuring a mold cavity 700*a*. Similarly, the spacing member 500*c* and 500*d* is positioned between the partition members 300*c* and 300*d* of the second set of partition members B for configuring a mold cavity 700*b*. Accordingly, the plurality of spacing members 500 is adapted to be received between respective partition members of the each of the first set of partition members A and the second set of partition members B, for configuring the plurality of mold cavity, such as mold cavities 700*a* and 700*b*, (herein in after collectively referred to as the plurality of mold cavities 700).

Further, the plurality of spacing members 500 may be configured to have various sizes, such that the plurality of spacing members 500 are capable of altering a size of the plurality of mold cavities 700. More specifically, as shown in FIG. 1, the plurality of spacing members 500, such as the spacing members 500*a*, 500*b*, 500*c*, and 500*b*, are configured to assume an elongated cuboidal structure having a specific width. Accordingly, by altering the width of the plurality of spacing members 500, to be positioned between partition members, the size of the plurality of mold cavities 700 may be altered. The plurality of mold cavities 700 having various sizes may be utilized for constructing different pre-cast structures, such as roof panels, wall panels, bridge sections, box culverts, underground supports, stair systems, concrete retainer walls, fencing, beams, and columns.

After the configuration of the plurality of mold cavities 700, the retainers 400 may be adjusted for retaining the configuration of the plurality of mold cavities 700. For example, the tensioning members 404*a*, 404*b* and 404*c* of the retainers 400*a* may be rotated for spacing apart the pair of mounting brackets 402*a* and 402*b* for pressing the of the first set of partition members A and the second set of partition members B. Similarly, the retainer 400*b* and 400*c* may be operated for pressing the of the first set of partition members A and the second set of partition members B, and thereby positioning the plurality of spacing members 500 in an intact manner between the partition members of the first set of partition members A and the second set of partition members B. Further, in one embodiment of the present invention, the plurality of spacing members 500 may be tack welded with the partition members, surrounding the plurality of spacing members 500. The tack welding enables in temporarily coupling the plurality of spacing members 500 with the partition members, surrounding the plurality of spacing members 500. Further, to strengthen the tack welding angle tables (not shown) may be welded with the spacing members 500 and the partition members, surrounding the plurality of spacing members 500.

Once the plurality of spacing members 500 is coupled between the plurality of partition members 300, a non-stick material, such as oil and grease, may be applied on the plurality of partition members 300. More specifically, surfaces of the plurality of partition members 300 and floor 202, configuring the plurality of mold cavities 700 are applied with the non-stick material. Thereafter, a building material may be poured into the plurality of mold cavities 700 (without the necessity of any injection port). Further, the building material, poured into the plurality of mold cavities 700, may be vibrated to ensure even distribution of the building material within the plurality of mold cavities 700. In one embodiment of the present invention, the building material may include a mixture of sand, cement, gravel, and water. In another embodiment, the building material may comprise Portland cement, alkaline-activated concrete, or geopolymer or a polymer.

The building material, poured into the plurality of mold cavities 700, enables in acquiring a shape of the plurality of mold cavities 700. In one embodiment of the present invention, tensioning wires (pre-tension or post-tension), rebar, or reinforcement steel may be inserted in the plurality of mold cavities 700 before pouring the building material in to the plurality of cavities 700. Insertion of the tensioning wires, rebar, or reinforcement steel enables in reinforcement of the pre-cast structures. Further, in one embodiment of the present invention, elements such as block outs for the windows, doors, basic plumbing, HVAC, electrical fitting, and weld plates that connect the architectural structures may be set in the plurality of mold cavities 700 before pouring the building material in to the plurality of mold cavities 700. Insertion of such elements enables in configuring various cavities in the pre-cast structures for various usages thereof. For example, the block outs for the windows may configure a pre-cast structure with an opening for configuring a window therein. (In that no added heat is needed for the curing of the building material, block outs from Styrofoam or other heat-intolerant materials may be utilized in connection herewith.) Moreover, in one embodiment of the present invention, the plurality of partition members 300 may be configured with various designs for incorporating the designs on the pre-cast structures. More specifically, a pair of first sheets of each of the plurality of partition members 300 may be configured with various patterns for constructing the pre-cast structures of various designs.

Further, by pouring a measured quantity of the building material into the plurality of mold cavities 700 various pre-cast structures may be constructed. The term "measured quantity" used herein refers to the various quantities of the building material required for constructing various pre-cast structures, such as roof panels, wall panels, bridge sections, box culverts, underground supports, stair systems, concrete retainer walls, fencing, beams, and columns In such instances, it will be evident to a person skilled in the art that based on the various sizes of the plurality of mold cavities 700 and the measured quantity of the building material various pre-cast structures may be constructed.

Further, the plurality of partitions members 300 is removed from the interior space 206 of the container 200 after a predetermined time. More specifically, the building material is allowed to cure in the plurality of molding cavities 700 and thereafter the plurality of partitions members 300 is removed from the interior space 206 of the container 200. (In another embodiment, the plurality of partition members 300 may be moved away from one another but remain otherwise within the container 200.) However, it will be evident to a person skilled in the art that before removing the plurality of partitions members 300, the plurality of spacing members 500 and the retainers 400 needs to removed from the container 200. More specifically, the tensioning members 404*a*, 404*b* and 404*c* may be rotated for bringing the pair of mounting brackets 402*a* and 402*b* closer to each other and thereby removing the retainers 400 from the container 200. Further, the plurality of spacing members 500 may be removed by breaking the tack welding between the spacing member and the partition members 300.

The plurality of partition members 300 is removed from the interior space 206 of the container 200 with the help of maneuvering mechanism 600 and the plurality of supporting arrangement 220 explained herein conjunction with FIGS. 1 and 4. The plurality of supporting arrangement 220 enables in supporting the plurality of partition members 300 on the floor 202 of the container 200, and the maneuvering mechanism 600 enables in maneuvering the plurality of partition members 300 within the interior space 206 of the container 200. More specifically, maneuvering hooks of the maneuvering mechanisms 600 may be inserted into the locking cavities of a partition member of the plurality of partition members 300 for lifting and separating the partition member. For example, maneuvering hook 608*a* of the maneuvering mechanism 600*a* may be received into the locking cavity 310*a* of the lateral frame member 306*a* of the partition member 300*a*. Similarly, a maneuvering hook of the maneuvering mechanisms 600*b* may be received into the locking cavity of (not shown) of the lateral frame member 306*b* of the partition member 300*a*. Thereafter, maneuvering chains of the maneuvering mechanisms 600*a* and 600*b* may be rolled with the help of movable members of the maneuvering mechanisms 600*a* and 600*b* for lifting the partition members 300*a*. Further, the movable members of the maneuvering mechanisms 600*a* and 600*b* may be slidably moved along support members of the maneuvering mechanisms 600*a* and 600*b* for separating the partition member 300*a* from a pre-cast structure, positioned between the partition member 300*a* and the partition member 300*b*.

Further, in such instances, the plurality of supporting arrangement 220 may be used for supporting the plurality of partition members 300 on the floor 202 of the container 200. The plurality of supporting arrangement 220 enables in avoiding the falling of the plurality of partition members 300 while maneuvering the plurality of partition members 300 within the container 200. For example, while lifting and separating the partition member 300*a* of the first set of partition members A, the partition member 300*b* may be supported on the floor 202 with the help of supporting arrangements 220*a* and 220*b* (see FIG. 2). More specifically, the support hooks 224*a* and 224*b* of the supporting arrangements 220*a* and 220*b*, respectively, may be inserted into locking cavities of pair of lateral frame members of the partition member 300*b*. Accordingly, the support chains 222*a* and 222*b* coupled to the support hooks 224*a* and 224*b*, respectively, holds the partition member 300*b* on the floor 202. Further, partition members of the first set of partition members A, adjacent to the of the partition member 300*b* are also supported with the help of supporting arrangements 220*a* and 220*b*. Similarly, partition members of the second set of partition members B may be maneuvered by the maneuvering mechanisms 600*a* and 600*b*, and supported by the supporting arrangement (not shown), such as supporting arrangement 220*a* and 220*b*.

Once a partition member is separated from the adjacent partition member, a pre-cast structure (not shown), positioned therebetween may be may be exposed. Thereafter, the pre-cast structures may be lifted from the container 200 by using a lifting device, such as a crane. Further, the plurality of partition members 300 may be also lifted out of the container 200 with the help of the lifting device and lifting lugs configured on longitudinal frame member of the plurality of partition members 300. For example, hooks of the crane may be inserted into the lifting lug 312*a* and 314*a* of the longitudinal frame member 308*a* of the partition member 300*a* for lifting the partition member 300*a* out of the container 200. Similarly, remaining partition members of the plurality of partition members 300 may be lifted out of the container 200. It will be apparent that the apparatus disclosed herein need not be fully disassembled to allow removal of a pre-cast structure from the apparatus, for example, the partition members 300 may be moved apart instead of removed from the container 200.

The container 200 may be cleaned after the removal of the plurality of partition members 300 from the container 200. For cleaning the container 200 the drainage portion 218 of the floor 202 may be utilized. More specifically, the longitudinal walls 204*a* and 204*b*, and the floor 202 may be washed with the help of a suitable medium, such as water, and thereafter waste water may be allowed to pass through the drainage portion 218 of the floor 202. Further, the plurality of partition members 300, the retainer 400, and the plurality of spacing members 500 may be cleaned for reusing the apparatus 100 for constructing pre-cast structure.

The apparatus, as explained herein conjunction with FIGS. 1 through 6, is capable of being easily transported to a construction site of an architectural structure. More specifically, as explained herein the container is a shipping container having international containers specification. Accordingly, the apparatus of the present invention may be easily transported to a construction site with the help of transportation means, such as road, rail, and water transport. In one embodiment of the present invention, the container of the apparatus may be configured to have the following dimensions: a length of about 20 feet to 53 feet, and a width of about 2 feet to 9 feet. In another embodiment, the container of the apparatus may be configured to be 38' long and 8½' high, and may be removably attached to a standard flatbed shipping trailer, to provide for easy transport to a construction site and ready removal from the trailer for setting up the container at a construction site. The portability of the apparatus of the present invention enables in constructing the pre-cast structures, such as roof panels, wall panels, bridge sections, box culverts, underground supports, stair systems, concrete retainer walls, fencing, beams, and columns, in the vicinity of the construction site. Accordingly, a transportation cost and a labor cost associated with the transportation of the pre-cast structures may be avoided, which enables in reducing an over all cost of building the architectural structures.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, and thereby enable others skilled in the art to best utilize the invention and various embodiments with various modifications as are suited to the particular use contemplated. It is understood that various omissions and substitutions of equivalents are contemplated as circumstances may suggest or render expedient, but such are intended to cover the application or implementation without departing from the spirit or scope of the claims of the present invention.

What is claimed is:

1. A portable molding apparatus for constructing pre-cast structures, the portable molding apparatus comprising:

a container comprising a floor, and a pair of longitudinal walls vertically extending from the floor of the container, wherein the pair of longitudinal walls and the floor configure an interior space therebetween;

a plurality of partition members adapted to be received in the interior space of the container in a spaced apart manner to be supported on the floor of the container;

at least one retainer adapted to be positioned between at least one pair of partition members of the plurality of partition members for configuring at least two sets of partition members; and a plurality of spacing members adapted to be positioned between partition members, wherein the plurality of spacing members, the floor of the container, and the partition members configure a plurality of mold cavities therebetween, and wherein the at least one retainer enables in maintaining configuration of the plurality of mold cavities, and wherein the plurality of mold cavities is adapted to receive a building material for constructing pre-cast structures, and wherein each partition member of the plurality of partition members comprises:

a pair of first sheets;

a pair of second sheets adapted to be disposed between the pair of first sheets;

a pair of lateral frame members adapted to be coupled to lateral peripheral edges of the pair of first sheets; and a pair of longitudinal frame members adapted to be coupled to longitudinal peripheral edges of the pair of first sheets, wherein each of the pair of lateral frame members comprises a locking cavity configured thereon, and wherein the container further comprises a plurality of supporting arrangements configured on the pair of longitudinal walls of the container for supporting the plurality of partition members on the floor of the container, and wherein each of the plurality of supporting arrangements comprises:

a support chain coupled to a longitudinal wall of the pair of longitudinal walls;

and a support hook coupled to the support chain, wherein the support hook is adapted to be received in the locking cavity of a lateral frame member of the pair of lateral frame members, such that the plurality of supporting arrangements enables in supporting the plurality of partition members on the floor of the container.

2. The portable molding apparatus of claim 1, wherein each of the pair of longitudinal frame members comprises at least one lifting lug configured thereon.

3. The portable molding apparatus of claim 1, further comprising a pair of maneuvering mechanisms configured between the pair of longitudinal walls of the container for maneuvering the plurality of partition members within the interior space of container.

4. The portable molding apparatus of claim 3, wherein each of the pair of maneuvering mechanisms comprises:

a support member adapted to extend between opposite top end corners of the pair of the longitudinal walls;

a movable member adapted to be slidably coupled to the support member to move between the opposite top end corners of the pair of the longitudinal walls;

a maneuvering chain adapted to be attached to the movable member at a first end of the maneuvering chain, wherein a length of the maneuvering chain is capable of being adjusted by the movable member; and a maneuvering hook adapted to be attached to the maneuvering chain at a second end of the maneuvering chain, wherein the maneuvering hook is adapted to be received in the locking cavity of a lateral frame member of the pair of lateral frame members, such that the pair of maneuvering mechanisms enables in maneuvering the plurality of partition members within the interior space of container.

5. The portable molding apparatus of claim 1, wherein the at least one retainer comprises:

a pair of mounting brackets; and at least one tensioning member configured between the pair of mounting brackets, the at least one tensioning member capable of adjusting a distance between the pair of mounting brackets.

6. The portable molding apparatus of claim 5, wherein the tensioning member is a turnbuckle.

7. The portable molding apparatus of claim 1, wherein the container further comprises a drainage portion configured at a portion of the floor of the container for enabling in cleaning the container.

* * * * *